United States Patent [19]

Nilssen

[11] Patent Number: 4,631,648

[45] Date of Patent: Dec. 23, 1986

[54] MODULAR SUSPENDED CEILING AND LIGHTING SYSTEM

[76] Inventor: Ole K. Nilssen, Caesar Dr., Rte. 5, Barrington, Ill. 60010

[21] Appl. No.: 629,221

[22] Filed: Jul. 9, 1984

[51] Int. Cl.[4] ..... F21S 1/14

[52] U.S. Cl. ..... 362/150; 362/219; 174/48; 339/20; 339/22 R; 52/39

[58] Field of Search ..... 362/145, 147, 148, 150, 362/152, 225, 391, 404, 219, 220; 52/28, 39, 221, 287, 484, 664, 173 R; 174/48, 49; 339/21 R, 20, 24, 135, 22 R

[56] References Cited

U.S. PATENT DOCUMENTS

| | | | |
|---|---|---|---|
| 879,909 | 10/1961 | Schumacher | 339/21 R |
| 1,718,252 | 6/1929 | Putnam | 339/22 R |
| 2,563,909 | 8/1951 | Bauer | 339/20 |
| 2,714,712 | 8/1955 | Riccardelli | 339/20 |
| 3,001,001 | 9/1961 | Bibb | 362/148 |
| 3,061,810 | 10/1962 | Boyd | 339/24 |
| 3,246,074 | 4/1966 | Neumann et al. | 52/221 |
| 3,651,443 | 3/1972 | Quilez | 339/20 |
| 3,710,530 | 1/1973 | Valtonen | 52/28 |
| 4,313,646 | 2/1982 | Millhimes et al. | 339/22 R |
| 4,367,417 | 1/1983 | Casasanta | 362/225 |
| 4,414,617 | 11/1983 | Galindo | 362/404 |
| 4,429,934 | 2/1984 | Vandenhoak et al. | 339/22 R |

FOREIGN PATENT DOCUMENTS

| | | | |
|---|---|---|---|
| 3001434 | 7/1981 | Fed. Rep. of Germany | 362/404 |

*Primary Examiner*—Charles J. Myhre

*Assistant Examiner*—David A. Okonsky

[57] ABSTRACT

A master power track is mounted along the periphery of a suspended ceiling. Plug-in-connected with this master track are light-weight modular power tracks serving as grid members of the suspended ceiling. The master track, which also serves as the conventional L-bar for the suspended ceiling, is provided with a relatively high frequency voltage; which voltage is then available at any point along the individual modular power tracks. The modular power tracks also serve as the T-bars of the suspended ceiling. Ceiling panels and light-weight fluorescent lighting fixtures are placed in the suspended ceiling grid structure, with each lighting fixture being plug-in-connected with one of its adjacent modular power tracks. The plug-in connection is accomplished below rather than above the ceiling; which implies that the space above the suspended ceiling may safely be used as air plenum. However, by using grooved ceiling panels and special connect means, the resulting ceiling is completely conventional in appearance. The fluorescent lighting fixtures are particularly light of weight due mainly to the fact that they are powered by high frequency voltage; which high frequency voltage permits the use of fluorescent lamp ballasting means of greatly reduced weight. Thus, there is provided a suspended ceiling wherein the light-weight lighting fixtures are readily installed and/or moved by simple plug-in connections, without requiring the services of a licensed electrician, yet in a manner that complies with the National Electrical Code.

29 Claims, 3 Drawing Figures

MODULAR SUSPENDED CEILING AND LIGHTING SYSTEM

BACKGROUND OF THE INVENTION

1. Field of Invention

The present invention relates to suspended ceilings having easily installable, removable and/or relocatable lighting means.

2. Description of Prior Art

Due to requirements of the National Electrical Code, lighting fixtures in suspended ceilings, as such fixtures are presently constituted, have to be wired-in by way of conduited or armored cable. As a result, the fixtures are not only difficult and highly time-consuming to install, but—once installed—they are also very difficult and time-consuming to remove and/or relocate. Moreover, their installation, removal and/or relocation require the services of a licensed electrician.

No method presently exists whereby such lighting fixtures can be safely and conveniently installed, removed and/or relocated, without requiring the use of conduited or armored cable, and without requiring the services of a licensed electrician.

SUMMARY OF THE INVENTION

Motivation and Rationale Underlying the Invention

The general motivation underlying the present invention derives from a fundamental insight to the effect that it appears feasible to provide for a cost-effective arrangement whereby lighting fixtures in a suspended ceiling can be safely and conveniently installed, removed and/or relocated by a person of but ordinary skills, and without requiring the services of a licensed electrician.

More specifically and as follows, the motivation and rationale comprises several individual perceptions.

(i) A first perception suggests that, if only the lighting fixtures could be powered from below the suspended ceiling, rather than from the air plenum space above, it would not be necessary to power the fixtures by way of conduited or armored cables. In fact, it would then be permissible, according to normal practices under the National Electrical Code, to provide power to each fixture by way of an ordinary flexible power cord with a plug—with this plug being plugged into an ordinary electrical outlet. Thus, if fixtures were to be installed in a suspended ceiling in this fashion, anyone of but ordinary skills could install, remove and/or relocate them.

Of course, having power cords hanging down from the lighting fixtures in a suspended ceiling would not in most applications represent an attractive proposition, and can not realistically be considered as a generally acceptable alternative to the presently used method of installation based on using conduits and/or armored cable.

(ii) A second perception suggests that by providing, along the underside of the suspended ceiling, a grid of power tracks of the type normally used with track lighting systems, and by providing fixtures with relatively short power cords protruding from the front of the fixtures, it is possible to power each fixture by way of plugging its power cord into a nearby power track and to thereby avoid the problem of power cords hanging down from the lighting fixtures. This arrangement would indeed provide for a simplification of the installation, removal and/or relocation of the lighting fixtures.

Never-the-less, the power cords with their plugs—even if made quite short and light-of-weight—would be quite visible and would probably be objectionable from an aesthetics viewpoint.

(iii) A third perception suggests that it is possible to provide a substantially non-visible electrical connection between the front part of a lighting fixture and an immediately adjacent power track: such connection being accomplished by way of a special power plug protruding through a side-opening near the bottom edge of a fixture and plugged directly into a side-located receptacle slot of the adjacent power track.

(iv) A fourth perception suggests that by making the power tracks of smaller than normal size, which is uniquely permissible in this particular situation since the tracks do not have to support any significant weight, and by integrating these smaller power tracks directly with the suspension grid of the suspended ceiling, it is possible to make the power tracks substantially non-visible; which, in effect, implies that it is possible to provide for a suspended ceiling that has the appearance of an ordinary suspended ceiling—without any conspicuous protrusions or other aesthetically non-acceptable features.

Consequently, it is indeed possible to provide for a suspended ceiling system in which the lighting fixtures can be safely and conveniently installed, removed and/or relocated by a person of but ordinary skills—without requiring the services of a licensed electrician. In fact, the lighting fixtures have been made into plug-in portable lighting means, with all the electrical distributions and connections being made below the air plenum space above the suspended ceiling.

(v) A fifth perception suggests that, by substantially reducing their weight, it is possible to make the lighting fixtures even safer and more convenient to install, remove and/or relocate.

In case of fluorescent lighting fixtures, which are by far the most commonly used lighting fixtures in suspended ceilings, substantial fixture weight reduction may be obtained by way of powering the fixtures with a voltage of relatively high frequency. That way, the requisite fluorescent lamp ballasts can be grossly reduced in weight; which implies that the weight of the complete fixture can be reduced by a substantial factor as well.

BRIEF DESCRIPTION OF THE PREFERRED EMBODIMENT

In its preferred embodiment, subject invention constitutes a modular suspended ceiling integrally combined with a fluorescent lighting system, and comprises the following key component parts and characteristics.

(a) A central power conditioner is mounted on the wall or on the ceiling in some convenient location above the plane of the suspended ceiling. This power conditioner is hard-wireconnected with the electric utility power line and provides a high-frequency voltage output of 120 Volt/30 kHz.

(b) A master power track extends around the periphery of the suspended ceiling. This master power track is hard-wireconnected with the 120 Volt/30 kHz output of the central power conditioner and serves not only as a master power track providing a 120 Volt/30 kHz voltage at its receptacle slots, but also serves as the L-bar ordinarily used along the periphery of a suspended ceiling for supporting the ceiling panels used therein. This combination master power track and L-bar is hereinafter referred to as the L-bar-track.

(c) A suspension grid consisting of substantially ordinary T-bars with light-weight power tracks fastened onto their bottom sides is suspended in the area enclosed by the L-bar-track. The combination T-bars and light-weight power tracks are hereinafter referred to as T-bar-tracks; and these T-bar-tracks are mechanically and electrically plug-in-connected with one another, as well as with the L-bar-track, in such a way as to form a complete modular suspension and power grid for a suspended ceiling and its associated lighting means.

The power tracks fastened onto the bottom of the T-bars have receptacle slots on their sides—but may also have receptacle slots on their bottom sides, in the usual fashion.

(d) Light-weight fluorescent lighting fixtures with high-frequency ballast means are positioned in and supported by the suspension grid structure at the various locations where light is desired. Each fixture has plug-in power input means located at its side, near its bottom edge, and is electrically connected with an adjacent T-bar-track by way of having its side-located plug means plugged into the T-bar-track's side-located receptacle slot.

(e) Ceiling panels are positioned in the suspension grid structure in each place where there is no lighting fixture. These ceiling panels have grooves along their edges, thereby providing for their undersides to be positioned in a flush relationship with the undersides of the T-bar-tracks.

(f) Thus, only the central power conditioner and the L-bar-track have to be installed in conventional hard-wired fashion; which installation probably requires the services of a licensed electrician.

(g) On the other hand, the T-bar-tracks as well as the lighting fixtures, may safely and conveniently be installed, removed and/or relocated in plug-and-receptacle fashion by any person of but ordinary skills—without requiring the services of a licensed electrician.

DETAILED DESCRIPTION OF THE PREFERRED EMBODIMENT

Details of Construction

Figure 1:
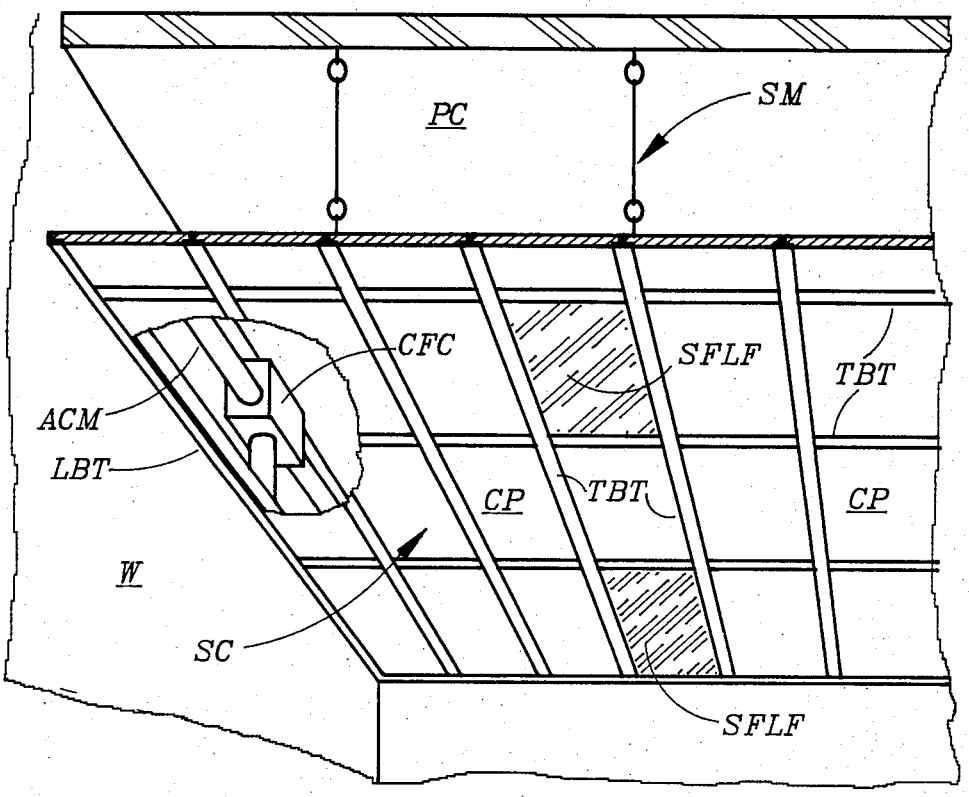
FIG. 1 provides an overall view of a modular suspended ceiling and lighting system in accordance with the preferred embodiment of the present invention.

In FIG. 1, central frequency converter CFC is mounted on wall W and connected with the power line by armored conductor means ACM. An L-bar-track LBT is mounted on the wall along the periphery of suspended ceiling SC; and T-bar-tracks TBT's are mounted in contact with the L-bar-track and, by way of suspension means SM, in suspended relationship with permanent ceiling PC.

Ceiling panels CP's and special fluorescent lighting fixtures SFLF's are placed into the suspended grid network formed by the L-bar-track and the T-bar-tracks.

Figure 2:
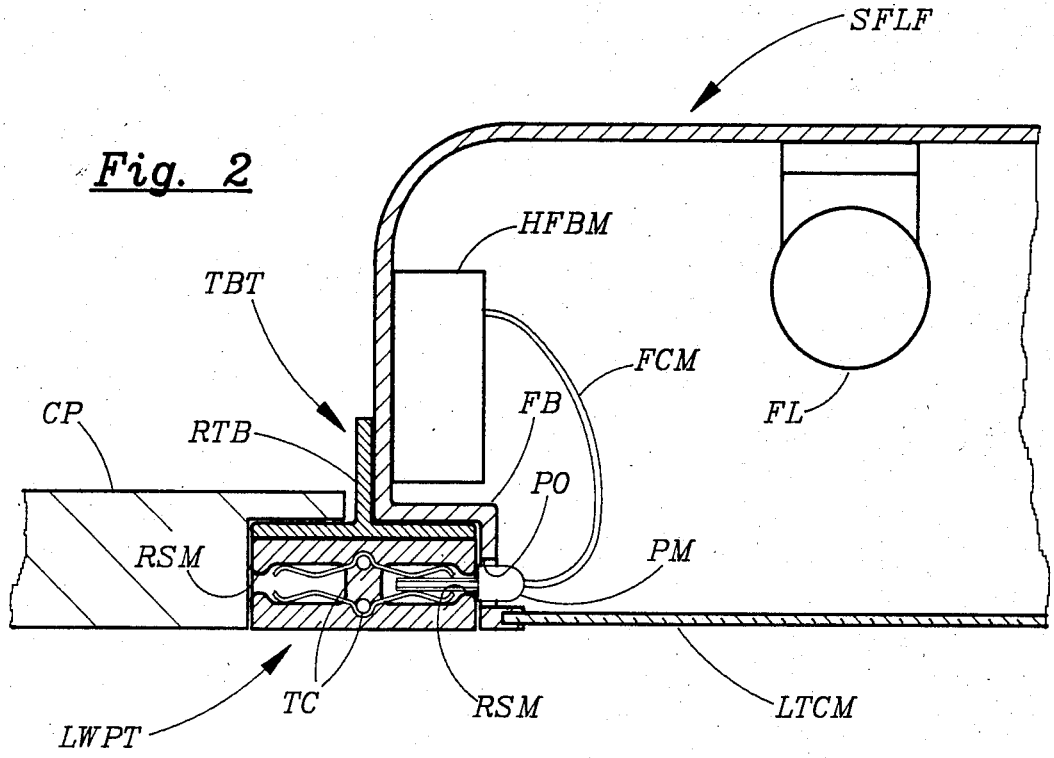
FIG. 2 provides details in respect to how a fluorescent lighting fixture is placed into the grid structure and connected with an adjacent T-bar-track.

FIG. 2 shows salient details in respect to how the ceiling panels and the special fluorescent lighting fixtures are mounted in relationship with the T-bar-tracks. More particularly, FIG. 2 shows a cross-sectional view of a T-bar-track TBT, part of a ceiling panel CP, and part of a special fluorescent lighting fixture SFLF.

Special fluorescent lighting fixture SFLF contains highfrequency ballast means HFBM suitable for powering fluorescent lamp FL from high-frequency voltage obtained by way of flexible conductor means FCM and plug means PM; which plug means is plugged into receptacle slot means RSM of T-bar-track TBT by way of a plug opening PO in the lower side of fixture body FB. A light-transmitting cover means LTCM is fastened onto the fixture body FB in such fashion as to cover the fixture's aperture.

T-bar-track TBT consists of a substantially regular T-bar RTB onto which is cemented or otherwise attached a relatively light-of-weight power track LWPT with track conductors TC.

Figure 3A:
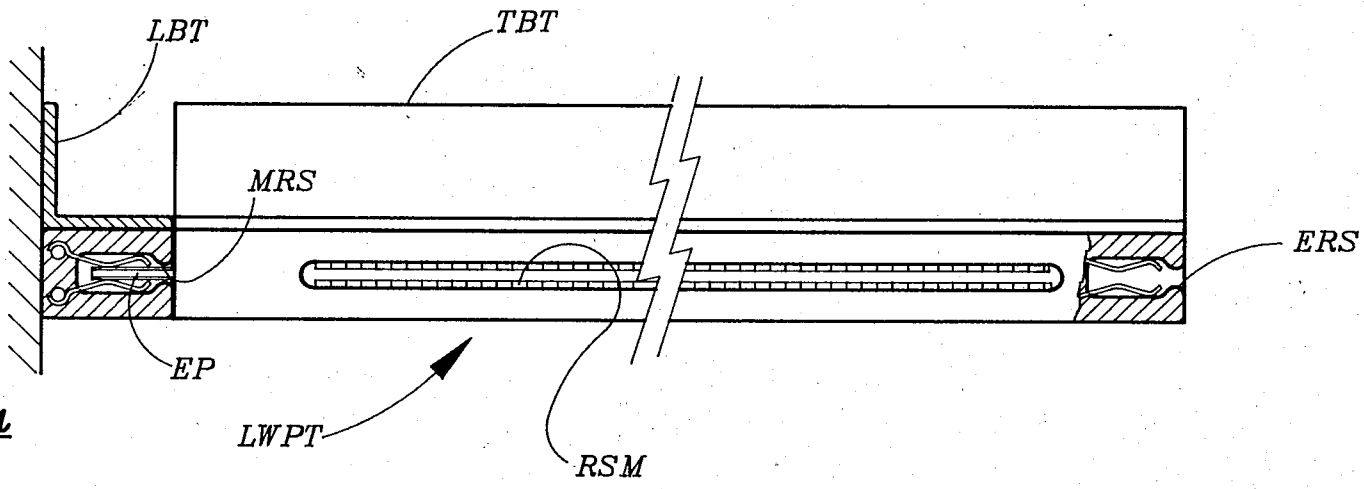
FIG. 3 provides details in respect to how a T-bar-track is plug-in-connected with an L-bar-track and/or with another T-bar-track.
Figure 3B:
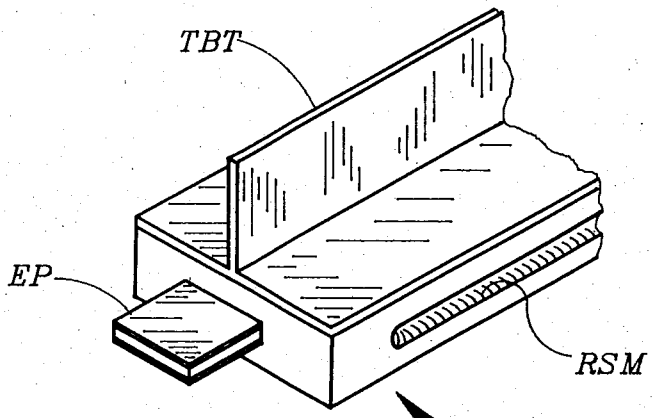
Figure 3C:
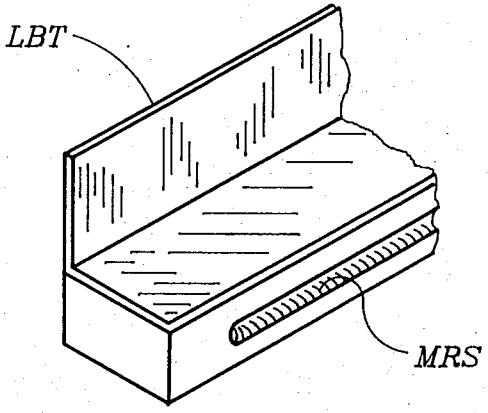

FIG. 3*a* shows salient details in respect to how the T-bar-tracks are electrically and mechanically connected with the L-bar-track LBT, as well as how these T-bar-tracks are connected with one another. More particularly, FIG. 3*b* shows how a plug-in end-prong EP is provided at one end of each T-bar-track TBT. This end-prong is adapted to plug and/or slide into the master receptacle slot MRS of the L-bar-track LBT (see FIG. 3*c*). Also, a plug-into end receptacle slot ERS is provided at one end of each T-bar-track, which end receptacle slot is adapted to receive and hold the end-prong of another T-bar-track.

Description of Operation

The operation of the above-described modular suspended ceiling and lighting system may be explained as follows.

In FIG. 1, the central frequency converter CFC is powered from the power line and provides an output of 120 Volt/30 kHz voltage, which voltage is applied to a set of track conductors in the L-bar-track LBT.

The 120 Volt/30 kHz voltage on the track conductors in the L-bar-track is provided to the track conductors on each of the T-bar-tracks plugged thereinto. Thus, a complete suspension and track power grid is constructed by plugging suspended T-bar-tracks into the L-bar-track as well as into each other, and the 120 Volt/30 kHz voltage beomes available adjacently to each and every lighting fixture.

After each lighting fixture has been placed into its desired position in the suspended grid structure, electrical connection is made by way of the fixture's side-located plug opening (PO). Through that opening, the ballast plug (PM) is plugged into the adjacent T-bar-track's receptacle slot, thereby providing 120 Volt/30 kHz power to the ballast. After the electrical connection is completed and fluorescent lamps installed, the fixture's light-transmitting cover means (LTCM) is put in place.

In respect to FIG. 2, it should particularly be noted that all the conductor and connector means carrying the 120 Volt/30 kHz power are located outside of the air plenum space (which is the air space between the permanent ceiling and the suspended ceiling). Thus, in effect, each one of the fixtures may be treated as a portable lamp.

The 120 Volt/30 kHz output of the central power conditioner is electrically isolated from the power line; which therefore permits the power distribution to be done without an accompanying ground wire. However, if power-line-isolation is not provided, grounding means would have to be provided; which grounding means could then be furnished in the form of a third conductor in the L-bar-track and in the T-bar-tracks—or, it could be accomplished by using the L-bar and T-bars themselves as ground conductors.

Additional Comments

It is noted that the power distribution system and lighting system described hereinabove is not in any way limited to using high frequency voltage on the L-bar-track and the T-bar-tracks. In fact, regular 120 Volt/60 Hz could readily be used; but then, of course, the weight of the fixtures would have to be higher. On the other hand, in a number of situations, it may prove advantageous to provide DC voltage on the tracks; and then to use an inverter-type ballast in each lighting fixture. In this latter case, however, the fixtures could still be of low weight.

It is also noted that subject power distribution and lighting system may be installed on a retro-fit basis. The master power track could be fastened onto the existing L-bar; and the individual grid power tracks could be fastened onto the existing T-bars.

Then, it is noted that the L-bar-track could readily consist of a central short section of L-bar-track, with additional sections of L-bar-tracks available for plug-in connection with this central L-bar-track, as well as with one another.

Another thing to note is the fact that it is not necessary that every T-bar in the suspended ceiling system grid be a carrier of electric power. For instance, it would be sufficient if only the T-bars in one of the directions carry electric power.

It is anticipated that the various L-bar-tracks and/or the T-bar-tracks be provided in various standard lengths, thereby facilitating easy installation.

In installations of relatively large suspended ceilings it will be necessary to use a plurality of central power conditioners; and, of course, it is then necessary that the outputs from the different power conditioners be treated as separate electrical circuits.

It is also anticipated that the T-bar-tracks be furnished with bottom-positioned receptacle slots—in addition to and/or instead of the side-positioned receptacle slots indicated in FIG. 1. That way, by using special light-of-weight lighting units designed to operate on 120 Volt/30 kHz power, the T-bar-tracks may be used as ordinary power tracks in the sense of constituting power tracks for more-or-less conventional track lighting means. For instance, it is anticipated that low-voltage reflector-type miniature Halogen lamps be conveniently used with these light-of-weight T-bar-tracks—requiring only very light-of-weight voltage transformers to produce the requisite low-magnitude lamp operating voltage from the 120 Volt/30 kHz T-bar-track voltage.

Of course, it is not a basic necessity that the lighting fixtures in subject suspended ceiling and lighting system be of the fluorescent type. On the contrary, it is anticipated that the lighting fixtures be of any desired type, be it fluorescent, incandescent (in which case it would not necessarily be advantageous to provide power in the form of 120 Volt/30 kHz), H.I.D., low-voltage Halogen, etc.

Then, it is also noted that more-or-less ordinary power tracks for a track lighting system may be positioned in nearly any-which-direction on the susended ceiling; and that these power tracks may be powered by way of plug-in-connection with nearby T-bar-tracks.

NATIONAL ELECTRICAL CODE 1984, published by NATIONAL FIRE PROTECTION ASSOCIATION of Quincy, Mass., is herewith by reference incorporated into this specification.

The central frequency converter (CFC) could as well have been mounted below the suspended ceiling. However, by having it enclosed in fire-proof casing, and by having its connecting conductors similarly protected (as in conduits), it is permissible to mount it within the air plenum space.

The term Air Plenum or Air Plenum Space refers to the air space between the suspended ceiling and the permanent ceiling thereabove—this air space being separated from the air space below the suspended ceiling by way of the ceiling panels and the lighting fixtures mounted in the grid openings formed between the T-bar-tracks and the L-bar-tracks.

It is believed that the present invention and its several attendant advantages and features will be understood from the preceeding description. However, without departing from the spirit of the invention, changes may be made in its form and in the construction and interrelationships of its cmponent parts, the form herein presented merely representing the presently preferred embodiment.

I claim:

1. A lighting system for a suspended ceiling, said suspended ceiling being suspended some distance below a permanent ceiling by way of a suspended grid with grid members and grid openings, said grid openings being covered by removable cover means thereby forming an enclosed air space between the two ceilings, the enclosed air space being useful as an air plenum, said cover means comprising ceiling panels and electric lighting means, said lighting system comprising:

a voltage source;

power track means attached to said suspended grid, said power track means having receptacle means and track conductors connected with said voltage source, said receptacle means being: i) operable to receive and hold electric plug means, and ii) accessible only from outside of said enclosed air space; and said lighting means being adapted to be powered from said voltage source by way of electric input means accessible only from outside of said air space, said input means having electric plug means adapted for plug-in insertion into said receptacle means;

such that disconnectable electrical connection is made between said voltage source and said lighting means while obviating the need for having electrical conductor means traversing said enclosed air space.

2. The lighting system of claim 1 wherein said power track means is integrally combined with at least one of said grid members.

3. The lighting system of claim 1 wherein said lighting means is located immediately adjacent said power track means.

4. The lighting system of claim 1 wherein, as long as said lighting means is positioned in said at least one grid opening and electrically connected with said voltage source, said input means, said plug means and said receptacle means are substantially hidden from view, thereby providing for said disconnectable electrical connection to be accomplished such as to be visually non-discernible when viewed from below the suspended ceiling.

5. The lighting system of claim 1 wherein said voltage source comprises frequency conversion means, and wherein the output from this voltage source is of a frequency substantially higher than that of the voltage on ordinary electric power lines.

6. A combination suspended ceiling and lighting system comprising:

grid structure suspended some distance below a permanent ceiling, said grid structure having grid members and grid openings;

ceiling panels, each one adapted to be removably positioned in and to cover one of said grid openings;

electrically powered lighting means, each one adapted to be removably positioned in and to cover one of said grid openings;

such that a suspended ceiling is formed by positioning lighting means and ceiling panels in said grid openings, thereby forming an enclosed air space between the two ceilings, the enclosed air space being useful as an air plenum;

a source of voltage; and power track means fastened to said grid structure, said power track means having receptacle means and track conductors connected with said voltage source, said receptacle means being: i) operable to receive and hold electric plug means, and ii) accessible only from outside of said enclosed air space;

each one of said lighting means being operable from said voltage by way of electric input means that is accessible only from outside of said air space, said input means having electric plug means adapted for plug-in connection with said receptacle means;

such that disconnectable electrical connection is made between said voltage source and each one of said lighting means while obviating the need for having electrical conductor means traversing said enclosed air space.

7. The system of claim 6 wherein said electric input means, said electric plug means and said receptacle means are substantially hidden from view, thereby providing for said disconnectable electrical connection to be accomplished such as to be visually non-discernible from below said suspended ceiling.

8. The system if claim 6 wherein said source is connected with an ordinary electric utility power line and comprises frequency converter means, and where said voltage is of a frequency substantially higher than that of the voltage on said power line.

9. A combination suspended ceiling and lighting system comprising:

grid structure suspended in a substantially horizontal plane some distance below a permanent ceiling, said grid structure having grid members and grid openings formed by said grid members, said grid structure being bounded by some of said grid members thereby forming a boundary;

a plurality of ceiling panels, each individual ceiling panel being removably positioned in and covering one of said grid openings;

a number of lighting means, each individual lighting means: (i) being removably positioned in and covering one of said grid openings, and (ii) having input means operable to receive electric power for actuating said lighting means, said input means comprising electric plug means;

a source of voltage;

master power track means fastened to said grid members along at least part of said boundary, said master power track means having master track conductors connected with said source of voltage; and grid power tracks fastened to some of said grid members in such a way that at least one grid power track is positioned adjacent each of said lighting means, said grid power tracks having grid track receptacle means and grid track conductors said grid track conductors being connected with said master track conductors at any point along a length of said master power track means, said grid track conductors also being disconnectably connected with said individual lighting means by way of said plug means and said grid track receptacle means.

10. The system of claim 9 wherein said grid power track means has four external surfaces substantially forming a rectangle in cross-section and where two of these surfaces are oriented in a substantially vertical plane, and where said grid track receptacle means are located on one or both of the vertically oriented surfaces.

11. The system of claim 9 wherein said lighting means comprises gas discharge lamp means adapted to be powered by a voltage of frequency substantially higher than 60 Hz, and wherein said source provides such a voltage of frequency substantially higher than 60 Hz.

12. The system of claim 9 wherein said input means, said plug means and said grid track receptacle means are substantially hidden from view and therefore non-discernable by visual inspection from below the suspended ceiling.

13. A lighting fixture for a suspended ceiling, said suspended ceiling having ceiling panels, each ceiling panel being removably positioned in a grid opening of a grid structure suspended some distance below a permanent ceiling, there being an enclosed air space defined by the two ceilings, said lighting fixture comprising:

means for holding an electric lamp and for powering it from a set of electric power input terminals; and mechanical structure to which is fastened said means, said mechanical structure being so constructed to be positionable in a grid opening in lieu of a ceiling panel and then to provide for said power input terminals to be accessible only from outside of said enclosed air space;

thereby permitting said lighting fixture to be positioned in one of said grid openings in a fashion similar to that of a ceiling panel and to be powered from a source of electric power located outside of said enclosed air space, while obviating the need for having electrical conductor means traversing said enclosed air space.

14. The lighting fixture of claim 13 wherein said lighting fixture, when positioned in a grid opening, effectively closes that grid opening, thereby substantially preventing air from flowing therethrough.

15. A lighting system for a suspended ceiling, said suspended ceiling being suspended underneath a permanent ceiling by way of a suspended grid with grid members and grid openings, said grid openings holding removable ceiling panels, there being an enclosed air space defined by the two ceilings, said lighting system comprising:

a source of voltage;

power track means fastened to said suspended grid, said power track means having receptacle means and track conductors connected with said source, said receptacle means being accessible only from outside of said enclosed air space; and a number of electric lighting means, each individual lighting means being positioned in one of said grid openings in lieu of a ceiling panel, said individual lighting means:(i) when positioned in one of the grid openings, being functional to substantially prevent air flow through that grid opening, (ii) being supported by that grid opening in a manner substantially identical to that in which a ceiling panel is supported, and (iii) having electric power input terminal means accessible only from outside of said enclosed air space, said input terminal means having plug means adapted for plug-in insertion into said receptacle means, thereby to provide for disconnectable connection between said track conductors and said input terminal means.

16. A suspended ceiling and lighting system comprising:

grid structure suspended some distance below a permanent ceiling, said grid structure having grid members and grid openings, each opening being framed by grid members;

ceiling panels, each one removably positioned in a grid opening, thereby substantially preventing air flow through that one grid opening;

electrically powered lighting means, each one removably positioned in a grid opening, thereby substantially preventing air flow through that one grid opening;

such that a suspended ceiling is formed by positioning ceiling panels and/or lighting means in said grid openings, thereby forming an enclosed air space between the two ceilings, the enclosed air space being useful as an air plenum;

a source of voltage;

power tracks fastened to said grid structure, said power track having receptacle means and track conductors connected with said source of voltage, said receptacle means being: i) operable to receive and hold electric plug means, thereby to connect the plug means with the track conductors, and ii) accessible only from outside of said enclosed air space; and electric input means for each one of said electric lighting means, said input means: i) being adapted to receive electric power for powering the lighting means, ii) being accessible only from outside of said enclosed air space, and iii) having electric plug means adapted for plug-in connection with said receptacle means;

such that disconnectable electrical connection is made between said source of voltage and each one of said lighting means, while obviating the need for having electrical conductor means traversing said enclosed air space.

17. The system of claim 16 wherein said electrical connection is accomplished in such a way as to be substantially non-discernible when viewed from below the suspended ceiling.

18. The system of claim 16 wherein said power tracks are mechanically integrated with said grid members and where there is at least one such power track located immediately adjacent each lighting means.

19. The system of claim 16 wherein said source is connected with an ordinary electric power line and comprises frequency conversion means operative to make said voltage of frequency substantially higher than that on said power line.

20. A combination suspended ceiling and lighting system comprising:

a source of voltage;

a grid structure suspended some distance below a permanent ceiling, said grid structure being comprised of interconnected individual segments of grid members and having grid openings for holding ceiling panels, the grid members having flange means for supporting these ceiling panels, each grid opening being framed by grid members, some grid members having integral power track means, these power track means having receptacle means and track conductors electrically connected with said source;

ceiling panels, each ceiling panel being removably positioned in a grid opening and suspended by the flange means of the surrounding grid members, thereby closing that opening to air flow; and a number of electric lighting means, each one of said electric lighting means: (i) being removably positioned in a grid opening and suspended by the flange means of the surrounding grid members, thereby closing that opening to air flow, that opening being framed by grid members of which at least one has integral electrical pwoer track means, thereby providing at least one such power track means immediately adjacent said one lighting means, (ii) being adapted to be powered by the foltage from said source, and iii) having electrical connect means by which to receive said voltage, said connect means being adapted to plug into the receptacle means of said at least one power track means located immediately adjacent said one lighting means to provide electric power from said source, said connect means being disconnectable from said receptcle means while said lighting means is maintained stationary in said grid opening.

21. A lighting system for a suspended ceiling, said suspended ceiling being suspended some distance below a permanent ceiling by way of a grid structure, said grid structure having grid openings, each of said grid openings being substantially closed to air flow by a removable ceiling panel, thereby forming an enclosed air space between the two ceilings that is useful as an air plenum, said lighting system comprising:

a voltage source;

power tracks fastened to the suspended ceiling, said power tracks having receptacle means and track conductors connected with said voltage source, said receptacle means being accessible only from outside of said enclosed air space;

a number of electrically powered lighting means, each of said lighting means being adapted to be positioned in one of said grid openings in lieu of one of said ceiling panels, thereby to effectively prevent air flow through said one of said grid openings, each one of said lighting means having power input means accessible only from outside of said enclosed air space; and connection means operable to disconnectably connect between said receptacle means and said power input means.

22. A combination ceiling and lighting system, comprising:

a suspended ceiling disposed some distance below a permanent ceiling, this suspended ceiling having:

(i) a periphery, (ii) a grid structure, (iii) power track means having receptacle means operable to receive and frictionally hold a power plug means, and (iv) lighting means placed in a position in said grid structure and having a power plug means operable to disconnectably connect with and to be held by said power track means by way of said receptacle means while said lighting means is maintained stationary in said position; there being an enclosed air space between said permanent ceiling and said suspended ceiling;

a source of electric power located near said periphery; and connect means operative to convey electric power from said source to said lighting means by way of said power track means, while obviating the need for having electrical conductors traversing said enclosed air space.

23. A suspended ceiling characterized by:

(a) being suspended some distance below a permanent ceiling;

(b) having a grid structure with grid openings;

(c) having, for each grid opening, a closure means operative to substantially close that grid opening to flow of air;

(d) having a periphery;

(e) being circumscribed by a wall surface that extends between the periphery and the permanent ceiling, thereby forming an enclosed air plenum space contained between the suspended ceiling, the wall surface, and the permanent ceiling;

(f) having at least one power track with track receptacle means accessible only from outside of the enclosed air plenum space, this power track being connected with a source of electric power; and (g) having a lighting means that: (i) constitutes one of said closure means, and (ii) is adapted to be powered from the power track by way of plug means disposed external of the air plenum space and operable to permit disconnectable electrical connection with the track receptacle means;

thereby permitting, by plug and receptacle means, electrical connection and disconnection between the power track and the lighting means to be performed external of the enclosed air plenum space.

24. A suspended ceiling characterized by:

(a) being disposed some distance below a permanent ceiling;

(b) having a top surface and a bottom surface so arranged as to constitute two separate physical surfaces, the top surface facing the permanent ceiling;

(c) comprising at least one power track with track receptacle means, this power track being connected with an electrical source and located substantially between the two separate surfaces; and (d) comprising a lighting means located substantially between the two separate surfaces and powered from the power track by plug means plugged there into, the track receptacle means being non-accessible from any location above said top surface along the entire length of said suspended ceiling.

25. A suspended ceiling characterized by:

(a) being suspended some distance below a permanent ceiling;

(b) having a top surface and a bottom surface so arranged as to constitute two separate physical surfaces;

(c) having power distribution means along said suspended ceiling and substantially comprised between the two surfaces and connected with a source of power; and (d) having lighting means substantially comprised between the two surfaces and adapted to be powered from the power distribution means by way of disconnectable connect means in such manner as to permit disconnectable electrical connection to be made between the power distribution means and the lighting means such that, after connection has been made, the connect means as well as the power distribution means are both substantially comprised between the two surfaces and visually non-discernible and non-accessible from above said top surface along the entire length of said suspended ceiling.

26. A suspended ceiling positioned some distance below a permanent ceiling and otherwise characterized by:

(a) having a periphery, along part of which is disposed a master power track having master receptacle means in the form of an elongated receptacle slot, this master power track being connected with a source of electric power;

(b) comprising a grid power track having plug means and being connected with the master receptacle means by way of this plug means which can be plugged into said elongated receptacle slot at any location there along;

(c) having lighting means adapted to be disconnectably connected with and powered from the grid power track.

27. A suspended ceiling disposed some distance below a permanent ceiling and characterized by:

(a) having a grid structure comprising T-bars and grid openings, each grid opening being covered by a cover means, some of the T-bars being combined with electrical power tracks, each power track being connected with a source of electric power and having track receptacle means so disposed as to prevent electrical access thereto from any point above the suspended ceiling; and (b) comprising a plurality of lighting means, each lighting means being removably positioned in a grid opening and, when so positioned, operative to constitute the cover means for that grid opening, and (ii) having electric power plug means operable to be plugged into said receptacle means in such manner as to be visually non-discernible from both below the suspended ceiling as well as from above the susended ceiling.

28. A suspended ceiling disposed some distance below a permanent ceiling and characterized by:

having a grid structure covering an area defined by a periphery and comprising: (i) L-bars disposed along this periphery, at least one of these L-bars formed with a master power track connected with an electric source and having master receptacle means, and (ii) T-bars disposed within the area defined by the periphery, at least one of the T-bars formed with a grid power track having grid receptacle means and grid plug means, the grid power track being disconnectably connected with the master power track by way of inserting the grid plug means into the master receptacle means;

thereby forming an electrical distribution system for the suspended ceiling and permitting electrical loads having power plug means to be powered by plug-in connection with said grid receptacle means.

29. A suspended ceiling disposed some distance below a permanent ceiling and characterized by:

(a) having a grid structure with grid openings, each grid opening holding a removable cover means; and (b) comprising electric power track means connected with a source of electric power and operative to distribute electric power to points along the grid structure, the power track having track receptacle means so disposed as to be accessible from above and below said suspended ceiling only when removing one of said cover means.

* * * * *